United States Patent [19]

Pearl, II et al.

[11] Patent Number: 4,846,670

[45] **Date of Patent: * Jul. 11, 1989**

[54] COMBUSTION DEVICE

[76] Inventors: David S. Pearl, II, 608 4th Key Dr., Fort Lauderdale, Fla. 33304; Louis H. Webb, III, 339 Gulfstream Rd., Dania, Fla. 33004; Stephen B. Kocell, 330, SE. 14th Ave., Pompano Beach, Fla. 33060

[ * ] Notice: The portion of the term of this patent subsequent to Mar. 22, 2005 has been disclaimed.

[21] Appl. No.: 133,082

[22] Filed: Dec. 15, 1987

Related U.S. Application Data

[63] Continuation of Ser. No. 927,946, Nov. 7, 1986, Pat. No. 4,732,559, which is a continuation-in-part of Ser. No. 828,187, Feb. 11, 1986, abandoned.

[51] Int. Cl.[4] ..... F23D 14/82

[52] U.S. Cl. ..... 431/346; 431/353; 431/354; 431/355; 48/189.6; 239/143; 239/346; 239/432

[58] Field of Search ..... 431/346, 326, 328, 349, 431/353, 354, 355, 347; 239/143, 343, 346, 396, 432, 462; 48/189.6

[56] References Cited

U.S. PATENT DOCUMENTS

| | | | |
|---|---|---|---|
| 396,260 | 1/1889 | Bell | 431/355 |
| 629,296 | 7/1899 | Johnson . | |
| 686,625 | 11/1901 | Machlet, Jr. | 431/349 X |
| 745,872 | 12/1903 | Machlet, Jr. | 431/349 |
| 1,006,324 | 10/1911 | Wermer . | |
| 1,015,851 | 1/1912 | Storrs . | |
| 1,058,702 | 4/1913 | Tait | 431/346 |
| 1,397,077 | 11/1921 | Tubb | 431/207 X |
| 1,510,060 | 9/1924 | Hoover et al. | 431/355 X |
| 1,818,471 | 8/1931 | Geauque . | |
| 1,908,135 | 5/1933 | Forster | 431/349 X |
| 1,945,902 | 2/1934 | Johnson | 431/355 X |
| 1,971,554 | 8/1934 | Forster | 431/349 |
| 2,531,015 | 11/1950 | Thompson | 431/346 X |
| 2,564,371 | 8/1951 | Parsberg | 431/355 X |
| 2,888,980 | 6/1959 | William et al. | 431/349 |
| 3,119,439 | 1/1964 | Weiss | 431/353 X |
| 3,574,506 | 4/1971 | Locke | 431/349 |
| 3,711,259 | 1/1973 | Gurney | 431/346 X |
| 3,752,644 | 8/1973 | Arnal | 431/353 X |
| 4,013,395 | 3/1977 | Wormser | 431/9 |
| 4,732,559 | 3/1988 | Pearl et al. | 431/346 |

FOREIGN PATENT DOCUMENTS

| | | |
|---|---|---|
| 2509588 | 9/1975 | Fed. Rep. of Germany . |
| 1383987 | 2/1975 | United Kingdom . |

*Primary Examiner*—Randall L. Green

[57] ABSTRACT

A combustion device which includes a forward section in which a baffle has been inserted for stalling the air and fuel mixture as it passes through the torch tip, generating a linear flame. The baffle is designed to include a substantially circular inner portion of wire screen, sintered powdered metal, or ceramic material, surrounded by a solid annular or substantially annular ring. A plurality of ribs extend between the annular ring and the inside of the tube for connecting the annular ring to the tube and for defining a number of outer passages through which air/fuel mixture may pass.

12 Claims, 3 Drawing Sheets

COMBUSTION DEVICE

BACKGROUND OF THE INVENTION

1. Cross-Reference to Related Applications

This application is a continuation of application Ser. No. 927,946, filed Nov. 07, 1986, now U.S. Pat. No. 4,732,559, which is a continuation-in-part of U.S. application Ser. No. 828,187, filed Feb. 11, 1986, abandoned. The disclosure of the foregoing patent is incorporated into this application in its entirety by reference thereto.

2. Field of the Invention

This invention relates to a fuel combuster, more particularly to a torch tip, and specifically to a hand held torch tip.

3. The Prior Art

Numerous attempts have been made to provide a torch tip which produces an even flame, which is easy to light, which will operate under any pressure, and which will not overheat.

U.S. Pat. No. 4,013,395 to Wormser discloses a fuel combuster which uses a vortex generator as a flame holder which results in a swirling flame. In this type of device, a relatively slight drop in gas pressure will cause the tube of the torch tip to overheat, because the velocity of the gas is not adequate to keep burning gas from contacting the tube. Further, increasing gas pressure in a high pressure torch tip, such as disclosed in the '395 patent, will narrow the flame to the point where it collapses and assumes an hourglass-like shape. A flame in such a shape has no utility for soldering or brazing because it loses heat concentration; the flame collapses, and will not effectively solder.

U.S. Pat. No. 1,510,060 to Hoover et el. discloses a gas burner with a mixing tube. A wire screen is supported adjacent to the end of a mixing tube bymeans of a cross bar. The wire screen is disclosed as serving to assist the breaking up of the air and gases are passed out of the tube, and ignition of the mixture is further disclosed to take place upon the wire screen.

U.S. Pat. No. 1,945,902 to Johnson discloses a burner having a combustion chamber formed with a circular aperture through which a burner tube is inserted. The aperture is provided with notches which edge the ignition area of the upper ignition into the burner tube. These apertures provide air inlet openings to the combustion chamber. A plurality of perforated baffle plates are located on the upper end of the burner tube, and are laid flat on top of each other in a closely adjacent relationship. These baffle plates comprise circular discs of twelve mesh fine iron wire cloth or other similar material, to preheat the premixed air and gas. The air and gas passes to an uppermost screen and is ignited therein.

U.S. Pat. No. 3,752,644 to Arnal discloses a hot air generator using a gaseous fuel. The mixture of primary air and gaseous fuel is drawn into the interior of the mixing tube by the centrifugal fan formed by a number of radial fins. This mixture is discharged into the interior of the combustion chamber, and is ignited by a pilot flame such that the flame is initiated on contact with a grid. The products of combustion are mixed with air pulsated by the fan, following which the mixture of hot air thus obtained is carried into the space to be heated.

U.S. Pat. No. 396,260 to Bell discloses an incandescent gas burner having a burner tube, which supports a wire-gauze diaphragm and a burner-tip. A deflector receives and protects the skirt of the mantle.

U.S. Pat. No. 629,296 to Johnson discloses a gas burner wherein gas travels through a number of conduits and through a seat. A ring of wire-gauze is arranged within the seat. The gas issues from a number of perforations and is ignited to form an annular belt of flame.

U.S. Pat. No. 1,015,851 to Storrs discloses a burner for incandescent mantles. The burner comprises a bunsen tube, a burner tip, a mantle and gauze. The gauze is of a curved shape and is provided with an upturned rim. The upturned rim and lower edge of the gauze lie within an annular chamber, the lower edge resting on the top of the tip and the upper edge resting in engagement with the annular shoulder. The gauze is disclosed as preventing back firing without impeding the passage of the gas/air mixture to the burner.

U.S. Pat. No. 1,058,702 to Tait discloses a testburner which includes a wire gauze disc held in position by an upper section and a lower section. The chamber of the lower section and the chamber of the upper section form a fuel expansion chamber across which gauze extends so that the gas from the pipe expands in the expansion chamber and passes through the gauze. Gas passes through the chamber of the upper section to the upper end of the chamber to the lower section and out of an opening. The gas burns in a full, regular jet which projects from the opening, and extends back into the chamber of the lower section to a greater or lesser extent determined by the volume and pressure of the gas. The gauze is disclosed as a flame barrier which prevents back lashing, and a barrier for solid particles in the gas.

U.S. Pat. No. 2,531,015 to Thompson discloses an internal ring brazing burner having a number of gas jets staggered around an annular flange in such a manner that if a sheet of flame is directed toward the center of the burner but tangent to a circle inside the periphery of the burner. A screen is inserted into an inner shell to prevent backfiring during operation of the burner. The screen is not near the flame and has no unction which pertains to flame holding.

U.S. Pat. No. 2,564,371 to Parsberg discloses a burner for giving flashing light. The burner includes a flange, in which a conical base for a grill mantle rests. A screen is situated below a flame deflector, and there is no indication that this screen can serve any function pertaining to flame holding.

The Wormser patent operates on swirl principles. The conventional swirl-type torch tips include a number of disadvantages. One of these disadvantages is that these types of torch tips easily overheat, due to even relatively slight drops in gas pressure. Another disadvantage is that an increase in the gas pressure will narrow the flame to the point where it collapses and assumes an hourglass-like shape.

the prior art linear principle devices have the disadvantage that they are typically extremely hard to light.

Standard high velocity torch tips, (e.g. those intended to operate with a high gas pressure) are subject to a further disadvantage. When the device is operated below a certain pressure or velocity, the standard tubes overheat. They turn red hot because the velocity is not adequate to keep the burning gas from contacting the tube.

None of the prior art devices provides a torch tip which is easy to light, will not overheat, and will operate over a wide pressure range.

OBJECTS OF THE INVENTION

It is therefore an object to the invention to provide a combustion device, more specifically a torch tip, which will burn over a much wider pressure range without overheating.

A still further object of the invention is to provide a baffle device which allows the gas, to stall temporarily, making it easier to light the flame.

It is still a further object of the invention to provide a baffle which will work with both high velocity and low velocity gases.

It is still a further object of the present invention to provide a torch tip which can sustain a substantial drop in the pressure range without overheating the tube.

SUMMARY OF THE INVENTION

The objects of the invention are achieved by providing a combustion device for generating a linear flame which includes means for combining a fuel gas and a combustion supporting gas, and means for stalling the combined fuel gas and combustion supporting gas when the combined gases are moving either at a low velocity or a high velocity.

In one embodiment, the combustion device of this invention comprises a metallic elongated tube, [e.g., a torch tip,] having a forward section terminating in a front end, a middle section and a rearward section, the middle section communicating at its respective ends with the forward section and the rearward section respectively. The rearward section is adapted, suitably at its rearward end, for connection to a source of combustible gas, and is suitably provided with axially positioned fuel jet means for injecting combustible gas into the tube and with apertures, suitably four or more in number, for intake of combustion supporting gas to be mixed with the combustible gas. The portion of the rearward section forward of the fuel jet means is provided with an axial passageway for transporting the combustible gas and the combustion supporting gas to the middle section. This passageway is of smaller diameter than the internal diameter of the forward section and the connecting middle section is at least in part of frustoconical shape, adapted to provide a Venturi effect.

The means for stalling the gases comprises a baffle positioned in the forward section. The baffle comprises a substantially circular inner portion, a generally annular portion surrounding the inner portion and a plurality of radially extending ribs which connect the baffle to the inside wall of the forward section.

The inner portion may be made of a wire mesh of heat resistant material, preferably of stainless steel, and operates to baffle low velocity combined gases. The wire mesh may define a substantially flat or curved surface. Preferably, it defines a curved surface, the central portion of the curve being the portion of the wire mesh closest to the front end of the forward section.

Preferably, the inner portion is gas permeable. The term "gas permeable", as used herein, refers to a structure which greatly slows, or even virtually stalls, a gas flowing against it, and reverses the flow of the majority of such gas. The gas passes through, greatly slowed, by wending its way between the particles comprising the "gas permeable" structure.

A "gas permeable" inner portion may be a wire mesh made of strands so closey spaced that light is not visible through the mesh. Mesh of plain Dutch weave is gas permeable within the meaning of the term as used herein.

The gas permeable inner portion may be a material comprising a randomly organized solidified matrix of particles. Preferably, this material is a sintered powdered metal, such as stainless steel. The material may instead be a ceramic material, such as alumina.

The term "gas permeable", as used herein, does not refer to structures which allow clear, unimpeded passage of gas. A tunnel, or even a screen through which light is visible, in the manner of a screen door, is not "gas permeable" as the term is used herein.

The generally annular portion and ribs are solid, and gas impermeable. The generally annular portion may be truly annular, polygonal, or of other modified annular shape;for instance, it may have a circular inner edge and a pentagonal outer edge, as shown in FIG. 7. It cooperates with the wire mesh to baffle high velocity combined gases. The plurality of ribs extend between the outer edge of the annular portion and the inside wall of the tube. The annular portion and the ribs are also made of heat resistant material, preferably stainless steel. High density sintered powdered metal is also suitable for the generally annular portion and ribs.

The entire baffle may be a single element of variable density sintered powdered metal or variable density ceramic material. In such a construction, the ribs and generally annular portion are of sufficient density so as to be gas impermeable, and the inner portion is of a density sufficiently low so as to be "gas permeable" within the meaning of the term as defined herein.

BRIEF DESCRIPTION OF THE DRAWINGS

The preferred embodiments of the invention will be discussed with reference to the drawings as follows.

DESCRIPTION OF PREFERRED EMBODIMENTS

Figure 1:
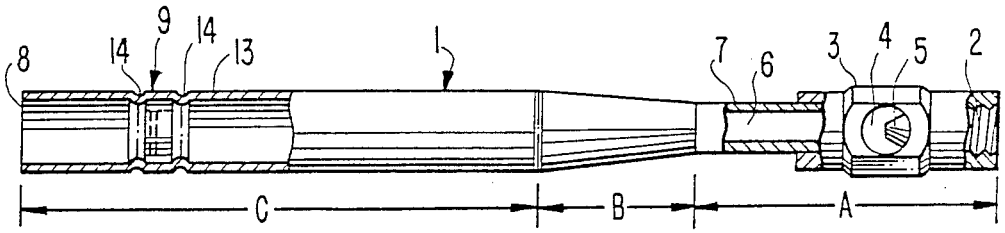
FIG. 1 is a side view of an embodiment of the torch tip of the present invention.

FIG. 1 is a side view of the torch tip 1 of the present invention. Torch tip 1 has a substantially tubular shape, and can be viewed as an elongated tube having three distinct sections A, B, C.

Section A is the rearward section of torch tip 1 which is adapted at its rearward end to be connected to a source of fuel as by internally threaded means 2 or other means, such as quick connects. Section A includes a middle portion 3 of substantially rectangular cross-section which has openings 4 through which air is introduced into torch tip 1. Openings 4 are shown here as four in number and as having a generally circular shape, but this is for illustrative purposes only, and it is understood that other shapes and/or numbers of openings 4 would be within the scope of the invention. An axially disposed jet nozzle 5 is included within the middle portion 3 of section A. The fuel gas passes from the source of fuel into and through jet nozzle 5. The fuel gas ejected by jet nozzle 5 mixes with air which is introduced into tube. 1 by openings 4. An axial passageway 6 is provided in the forward portion of the rearward section A for the passage of fuel gas and air into section B of the torch tip 1.

Connecting means 2, middle portion 3 and jet nozzle 5 are preferably made of brass. Axial passageway 6 is suitably provided by a stainless steel tube 7 which extends into and is joined to middle portion 3.

Section B is the middle section of torch tip 1 and is of a generally frustoconical shape. It is preferably made of stainless steel. This section provides a Venturi effect causing a large quantity of air to be sucked in by the cold fuel gas ejected by jet nozzle 5 and expanded and mixed with the fuel gas prior to burning. This creates a highly efficient flame with good characteristics.

Section C is the forward section of torch tip 1. It has a generally cylindrical shape, and is preferably made of stainless steel. The internal diameter of Section C is larger than the diameter of passageway 6. Its outlet 8 constitutes the flame end of the torch tip. As shown in the cutaway portion of section C, a baffle 9 is positioned within this section.

Figure 3:
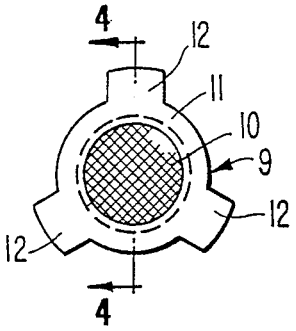
FIG. 3 is an enlarged front view of the baffle shown in FIGS. 1 and 2.
Figure 4:
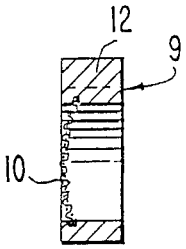
FIG. 4 is a cross-sectional view of the baffle, employing a curved wire mesh, taken along plane 4 of FIG. 3.
Figure 2:
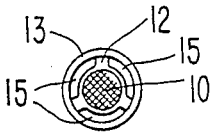
FIG. 2 is an end view of the torch tip of that embodiment.
Figure 5:
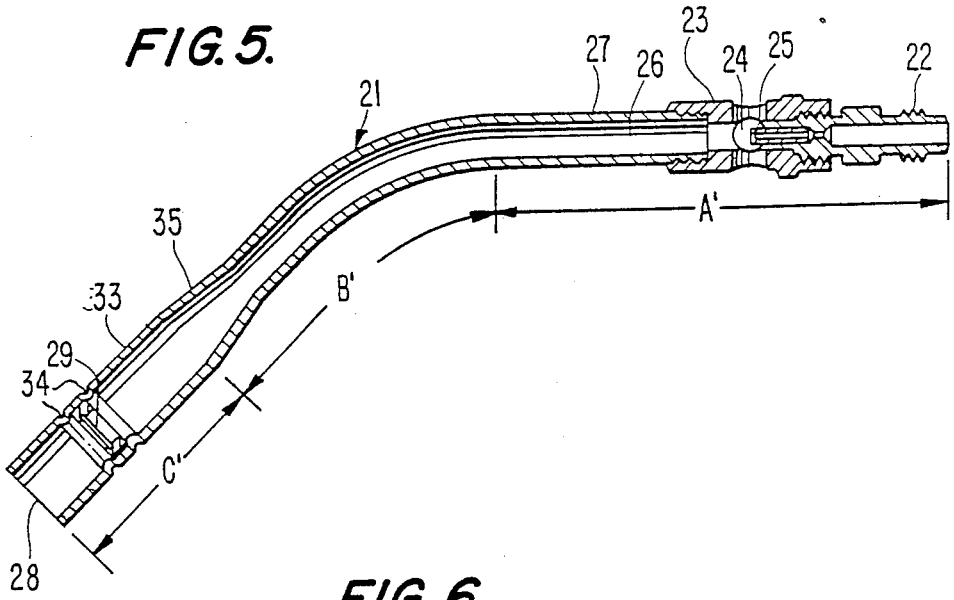
FIG. 5 is a side view of another embodiment of the torch tip of the present invention.

FIGS. 2, 3 and 4 further illustrate baffle 9 of the present invention.

Baffle 9 includes a substantially circular wire screen 10. Wire screen 10 preferably defines a curved surface, situated in Section C so that the central portion of the curve is the portion of the screen closest to flame end 8 of tube 1. Wire screen 10 is further preferably made out of stainless steel woven in a plain Dutch weave pattern.

Surrounding wire screen 10 is a solid metallic annular ring 11, also preferably of stainless steel. Wire screen 10 is fastened in a groove in annular ring 11, or is made integral with annular ring 11 by any other suitable means.

Extending from annular ring 11 are a plurality of outwardly and radially extending symmetrically positioned ribs 12, preferably of stainless steel. Ribs 12 serve to connect the annular ring with the inside of wall 13 of torch tip 1. Ribs 12 are constrained inside torch wall 13 by friction and/or crimps 14 in the torch tip wall, or by other suitable permanent attachment method. Spaces 15 are provided at the outside edge of annular ring 11, between ribs 12.

The phenomena occurring in the operation of the invention are not fully understood. To the extent which these have been detected and analyzed, they are discussed below.

Baffle 9 serves to stall the fuel and air mixture, further enhancing combustion. In operation, the temperatures of the object heated with air/MAPP mixture is approximately 2,100° F. and for an air/propane mixture, approximately 1750° F. (MAAP is a trademark of AIRCO, Inc. for methyl acetylene-propadiene). The torch tip of the present invention burns with a blue flame which indicates a more complete combustion. This is,in distinction to the swirl type device of the '395 patent which has a large green area indicating unburned fuel. The fuel tip of the present invention can operate at a pressure behind the jet nozzle 5 orifice in the range of 12 psi to 50 psi on MAPP. The device of the '395 patent is limited to pressures of between 25psi and 40psi on MAPP.

In operation, the solid portion of baffle 9, i.e. ring 11 and ribs 12, is the high velocity area; when the gas is at high velocity, the primary flame holding occurs on the forward surface of the solid portion. Wire screen 10 is a low velocity area; when gas is at a low velocity, the primary flame holding occurs on the wire screen. Burning takes place from immediately in front of the baffle and extends outside of the tip, but does not touch the inside of wall 13 of the tip. Therefore the tip does not get hot even when the gas is at a low velocity.

The particular design of baffle 9 in the present invention provides a number of advantages.

A wire screen alone, with no solid exterior portion would only work at a low velocity air/fuel mixture to baffle the gas and slow it down enough for the gas to burn. A totally wire baffle creates problems with thermal stability. As the temperature changes, the screen becomes wavy and changes shape. Additionally, such a screen would not remain in place within the tube.

A solid device likewise would not be adequate because the solid baffle would hold the gas back, which would make igniting the torch more difficult. The solid baffle would also produce the eddies in the gases, which create the mixing necessary for combustion, only over a limited velocity range. Moreover, the torch tip employing a solid baffle would be ignitable at only one specific pressure point.

Likewise a solid disc with little holes is not sufficient.

The spaces 15 let the gas and air mixture through the baffle at a higher velocity. When the gas is ignited, there is slow moving gas coming through the wire screen and faster moving gas through the spaces 15 on the outside of annular ring 11. The gas inside the screen will ignite first, providing enough heat for the gas on the outside of the annular ring to be ignited.

The elements of the torch tip are configured and arranged so that the flow of gases passing through spaces 15 provides a Venturi effect, causing a pressure reduction on the face of wire screen 10 which extracts gas molecules through the screen. Combustion is accordingly caused to occur above wire screen 10.

Wire screen 10 reverses the majority of the gas which contacts the screen; this effect is enhanced where the screen defines a curved surface with the central portion of the curve being that portion of the screen closest to flame end 8 of tube 1. As a result, dwell time of the gases in the torch tip is increased, and mixing of the gases is enhanced.

The type of wire mesh suitable for screen 10 is that which provides sufficient resistance to greatly slow or stall passage of the gases through the screen, but allows enough gas to be extracted through for ignition. One wire screen which meets these requirements is plain Dutch weave of 50 warp ×250 shute, with 0.0055" warp and 0.0045" shute, and 60 nominal micron retention.

The device of the present invention creates a flame which will stay linear and substantially unnarrowed in the operable pressure range. The higher velocity of the gas and air mixture moving through space 15 imparts, as it flows past the article to which the flame is applied, a "wrapping" effect to the cone — that is, the flame tends to wrap around the article to which it is applied. This wrapping effect provides for a more even distribution of heat than is achieved where the flame must be applied to one side of the article at a time. The device of the Wormser patent also provides for a wrapping effect, but not to the same extent as the device of the present invention.

FIGS. 5–8 illustrate a torch tip embodiment 21 generally similar to that shown in FIGS. 1–4. The forward section C′ is substantially the same as forward portion C in FIG. 1. The middle section B′ differs from middle section B in FIG. 1 by having a generally arcuate shape. Middle section B′ includes a generally frustoconical portion 35, the larger diameter end of which is joined to the rearward portion of Section C . Rearward section A′ is adapted to be connected to a source of combustible gas, as by externally threaded end portion 22, a quick connect or other means. Section A′ includes a middle portion 23 which, as shown, has four openings 24, suitably circular or generally circular, for the intake of air and an axially disposed jet nozzle 25. However, other shapes and numbers of openings may be employed. An axial passageway 26 is provided in the forward portion of the rearward section A′. Axial passageway 26 is suitably provided by a tube 27 which extends into and is joined to middle portion 23.

Figure 6:
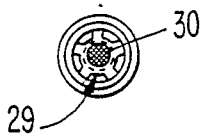
FIG. 6 is an end view of the torch tip of that embodiment.
Figure 7:
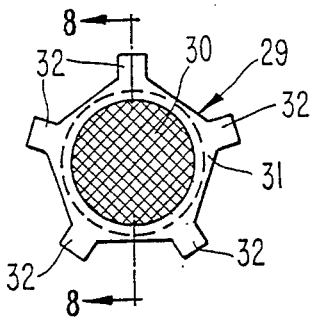
FIG. 7 is an enlarged front view of the baffle shown in FIGS. 5 and 6.
Figure 8:
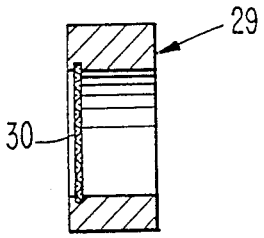
FIG. 8 is a cross-sectional view of the baffle, employing a substantially flat wire mesh, taken along plane 8 of FIG. 7.

FIGS. 6, 7, and 8 illustrate baffle 29. Baffle 29 includes a substantially circular wire screen 30. Surrounding wire screen 30 is a solid metallic modified annular portion 31, the annular shape being modified in the sense that the outer portion is generally in the shape of a regular polygon with symmetrically spaced outwardly projecting radial ribs 32. Ribs 32 serve to connect the modified annular portion 31 with the inside of wall 33 of torch tip 21, suitably with the aid of crimps 34 in the torch tip wall.

Except for the differences as illustrated in the figures and discussed above, the construction and operation of the embodiment of FIGS. 5–8 is otherwise similar to those of FIGS. 1–4 and provides the same advantage.

Figure 9:
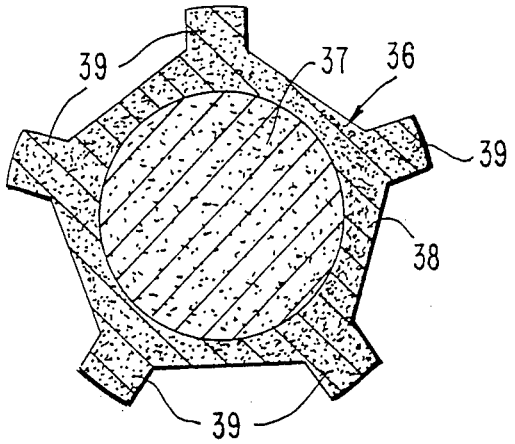
FIG. 9 is a cross-sectional view of the baffle, comprising a single element of variable density powdered sintered metal.

Fig. 9 illustrates baffle 36, comprising a single element of variable density sintered powdered stainless steel. Baffle 36 includes gas permeable inner portion 37. The term "gas permeable", as discussed earlier herein, refers to ther property of greatly slowing, or even virtually stalling, a gas flowing against it, and reversing the flow of the majority of such gas; gas passes through, greatly slowed, by winding its way between the particles comprising inner portion 37. Substantially annular gas impermeable portion 38 surrounds inner portion 37. Gas impermeable ribs 39 of baffle 36 serve to connect baffle 36 with the inside wall of the torch tip.

Figure 10:
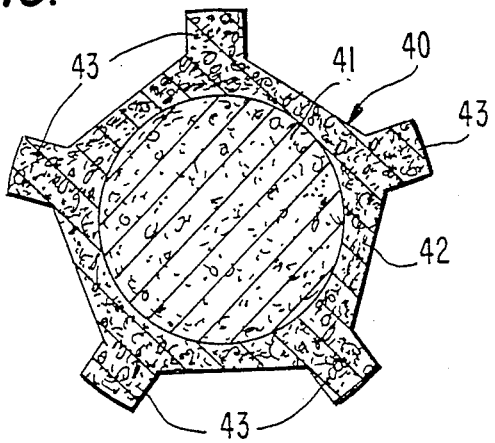
FIG. 10 is a cross-sectional view of the baffle, comprising a single element of variable density ceramic material.

Fig. 10 illustrates baffle 40, comprising a single element of variable density alumina. Corresponding to baffle 36, baffle 40 is provided with gas permeable inner portion 41, gas impermeable ribs 43.

As with baffle 9 and 29, baffles 36 and 40 are constrained inside the torch wall by friction and/or crimps, or by any other suitable permanent attachment method.

Like the phenomena occurring in the operation of the invention, also not fully understood is the relative importance of the different elements, or the relationship of their dimensions necessary for operability. However, dimensions for particular embodiments which are operative are listed in the Table.

TABLE

| Model Number | LPT4 | LPT5 | LPT6 |
|---|---|---|---|
| Distance along central axis of baffle and torch tip tube between front end of baffle and flame end of torch tip tube | 0.528″–0.750″ | 0.640″–1.575″ | 0.640″–1.87 |
| Length of baffle along central axis of baffle and torch tip tube | 0.187″ | 0.205″ | 0.205″ |
| Distance along central axis of baffle and torch tip tube between front end of baffle and central portion of front side of wire screen | 0.020″ | 0.020″ | 0.020″ |
| Distance along central axis of baffle and torch tip tube between front end of baffle and central portion of rear side of wire screen | .040″ | .040″ | .040″ |
| Diameter of wire screen | 0.300″ | 0.440″ | 0.540″ |
| No. of ribs on baffle | 3 | 5 | 5 |
| Degrees of radius between centers of immediately adjacent ribs | 120° | 72° | 72° |
| Geometrical configuration of annular ring or modified annular ring | annular | circular inner edge, pentagonal outer edge | circular inner edge, penagonal outer edge |
| Diameter of baffle to inner edge of annular ring or modified annular ring | 0.250″ | 0.390″ | 0.500″ |
| Diameter of baffle to outer edge of annular ring or modified annular ring | 0.325″ | — | — |
| Diameter of baffle to end of rib | 0.437″ | 0.688″ | 0.875″ |
| Diameter of torch tip tube at flame end | 0.437″ | 0.688″ | 0.875″ |
| Length of rib between edges of rib which intersect annular ring or modified annular ring | 0.100″ | 0.100″ | 0.100″ |
| Height of rib from outer edge of annular ring or modified annular ring to edge of rib farthest from annular ring or modified annular ring | 0.056″ | 0.075″ | 0.100″ |
| Distance between nearest edges of adjacent ribs at points where the ribs intersect the outer edge of the annular ring or modified annular ring | 0.397″ | 0.235″ | 0.312″ |

although the invention has been specifically described with reference to particular means and embodiments, it is to be understood that the invention is not limited to the particulars disclosed but extends to all equivalents within the scope of the claims.

We claim:

1. A combustion device for generating a linear flame comprising:

(a) means for combining a combustible gas and a combustion supporting gas, said means comprising an elongated tube having a forward section terminating in a front end, a middle section, and a rearward section, said middle section communicating at its ends with said forward section and said rearward section, respectively, said rearward section being provided with combustible gas and combustion supporting gas intake means; and (b) stalling means for stalling said combined combustible gas and combustion supporting gas, said stalling means comprising a baffle positioned in said forward section, said baffle comprising:

(1) a gas permeable inner portion which precludes unimpeded passage of a gas therethrough, said gas permeable inner portion having a density such that a gas flowing against said inner portion is greatly slowed, and the flow of a majority of said gas is reversed, said inner portion allowing said greatly slowed gas to pass therethrough;

(2) a gas impermeable generally annular portion surrounding said inner portion; and (3) a plurality of gas impermeable radially extending ribs which connect said baffle to the inside wall of said forward section and define a plurality of passageways between said inside wall and said gas impermeable generally annular portion.

2. A combustion device according to claim 1 wherein said baffle comprises a single element of variable density powdered sintered metal.

3. A combustion device according to claim 1 wherein said baffle comprises a single element of variable density ceramic material.

4. A combustion device according to claim 1 wherein said gas permeable inner portion comprises a randomly organized solidified matrix of particles.

5. A combustion device according to claim 4 wherein said randomly organized solidified matrix of particles comprises a sintered powdered metal.

6. A combustion device according to claim 4 wherein said randomly organized solidified matrix of particles comprises a ceramic material.

7. A torch tip comprising:

(a) a cylindrical forward section terminating in a front end;

(b) stalling means for stalling an air and combustible gas mixture passing through said torch tip, said stalling means being positioned in said forward section and comprising:

(1)a gas permeable inner portion which precludes unimpeded passage of a gas therethrough, said gas permeable inner portion having a density such that a gas flowing against said inner portion is greatly slowed, and the flow of a majority of said gas is reversed, said inner portion allowing said greatly slowed gas to pass therethrough;

(2) a gas impermeable generally annular portion surrounding said inner portion; and (3) a plurality of gas impermeable radially extending ribs which extend between said gas impermeable generally annular portion and an inside wall of said forward section, said plurality of radially extending ribs defining a plurality of passageways between said inside wall and said gas impermeable generally annular portion.

(c) a rearward section for receiving combustible gas and air including fuel jet means and an air induction system, the forward end of said rearward section having an axial cyclindrical passageway for receiving the air and combustible gas mixture, said passageway having a diameter smaller than the internal diameter of said forward section; and (d) a middle section, including a generally frustoconical portion, communicatively connecting said forward section to said cylindrical passageway and adapted to provide a Venturi effect.

8. A combustion devioe according to claim 7 wherein said stalling means comprises a single element of variable density powdered sintered metal.

9. A combustion device according to claim 7 wherein said stalling means comprises a single element of variable density ceramic material.

10. A combustion device according to claim 7 wherein said gas permeable inner portion comprises a randomly organized solidified matrix of particles.

11. A combustion device according to claim 10 wherein said randomly organized solidified matrix of particles comprises a sintered powdered metal.

12. A combustion device according to claim 10 wherein said randomly organized solidified matrix of particles comprises a ceramic material.

* * * * *